US007503445B2

(12) United States Patent
Yoshioka

(10) Patent No.: US 7,503,445 B2
(45) **Date of Patent: *Mar. 17, 2009**

(54) BILL HANDLING MACHINE AND BILL STORAGE UNIT

(75) Inventor: Kazuei Yoshioka, Tokyo (JP)

(73) Assignees: Aruze Corp., Tokyo (JP); Seta Corp., Tokyo (JP)

( * ) Notice: Subject to any disclaimer, the term of this patent is extended or adjusted under 35 U.S.C. 154(b) by 40 days.

This patent is subject to a terminal disclaimer.

(21) Appl. No.: 11/269,904

(22) Filed: Nov. 9, 2005

(65) Prior Publication Data

US 2006/0102446 A1 May 18, 2006

(30) Foreign Application Priority Data

Nov. 18, 2004 (JP) ..... 2004-335151

(51) Int. Cl.
*G07F 9/10* (2006.01)

(52) U.S. Cl. ..... 194/350

(58) Field of Classification Search ..... 194/350, 194/208, 209, 353; 271/188, 209
See application file for complete search history.

(56) References Cited

U.S. PATENT DOCUMENTS

| | | | | |
|---|---|---|---|---|
| 4,293,214 | A * | 10/1981 | George et al. | 399/403 |
| 4,732,375 | A | 3/1988 | Tetherton | |
| 5,163,672 | A | 11/1992 | Mennie | |
| 5,462,150 | A * | 10/1995 | Chang | 194/206 |
| 5,467,405 | A | 11/1995 | Raterman et al. | |
| 5,555,083 | A * | 9/1996 | Kuo et al. | 399/406 |
| 5,564,545 | A | 10/1996 | Suzuki | |
| 5,662,202 | A * | 9/1997 | Suris | 194/206 |
| 5,957,598 | A * | 9/1999 | Berkers et al. | 400/630 |
| 6,135,447 | A * | 10/2000 | Lin | 271/229 |
| 6,158,565 | A * | 12/2000 | Mikami et al. | 194/206 |
| 6,394,444 | B1 | 5/2002 | Ito et al. | |
| 6,913,260 | B2 * | 7/2005 | Maier et al. | 271/265.04 |
| 2001/0017276 | A1 | 8/2001 | Yasuda et al. | |
| 2002/0173874 | A1 | 11/2002 | Lax | |
| 2003/0094402 | A1 | 5/2003 | Seo et al. | |

FOREIGN PATENT DOCUMENTS

| | | |
|---|---|---|
| CN | 1421824 | 6/2003 |
| EP | 0 038 918 | 11/1981 |
| JP | 61-37658 | 2/1986 |
| JP | 63-230471 | 9/1988 |
| JP | 8-123991 | 5/1996 |

* cited by examiner

*Primary Examiner*—Patrick Mackey
*Assistant Examiner*—Mark Beauchaine
(74) *Attorney, Agent, or Firm*—Leydig, Voit & Meyer, Ltd.

(57) ABSTRACT

A bill storage unit has a bill storage portion for storing bills and a bill validator which takes in a bill to validate the bill. A feeding device feeds the bill delivered from the bill validator to the bill storage portion along a feeding path. A correcting device removes a fold in the bill by applying a force stretching the bill, while the bill is being supported and guided along at least part of the feeding path.

7 Claims, 12 Drawing Sheets

BILL HANDLING MACHINE AND BILL STORAGE UNIT

The present disclosure relates to subject matter contained in Japan Patent Application No. 2004-335151 filed on Nov. 18, 2004, which are expressly incorporated herein by reference in its entireties.

BACKGROUND OF THE INVENTION

The present invention relates to a bill handling machine used in various game machines such as a slot machines, pinball machines, and card game machines, vending machines and the like (hereinafter referred to as game machines and the like) and to a bill storage unit constituting the bill handling machine.

In general, the game machine as described above uses a bill handling machine which validates the validity of a bill inserted by a user, and stores a bill validated as being legitimate. Such a type of bill handling machine is incorporated into the game machine, or into an apparatus (the-so-called sandwich apparatus installed between game machines) related to the game machine, and is comprised of a bill validator that validates the validity of a bill inserted from a bill insertion slot, and a bill storage apparatus that successively stores a bill validated as being legitimate, for example, as disclosed in JP H08-123991.

The bill validator of the bill handling machine has a bill detecting sensor that detects passage of a bill, an validating sensor to validate the validity of the bill, a driving motor that feeds the bill, a controller that controls actuators of these sensors and motor, while validating the validity of the bill based on a detection signal from the validating sensor, and the like. Further, the bill storage apparatus has a feeding mechanism provided with a driving motor, feeding roller and the like to feed the bill validated as being legitimate to a bill storage portion, a pushing mechanism that stacks bills to place in the bill storage portion, and the like.

Among bills handled by the bill handling machine, there are some bills with folds and the like. Accordingly, when such bills with folds are taken in the bill handling machine without correction, problems arise that bills cannot be stacked and stored in good shape in the bill storage portion, and/or the number of bills stored in the bill storage portion is restricted by the clearance formed between bills in the bill storage portion due to the folds.

Such problems are resolved by the pushing mechanism as disclosed in JP H08-123991, but such a pushing mechanism is complicated in structure, and has problems that its assembly is also complicated and the manufacturing cost becomes high. Further, another problem may arise that it is not possible to reserve a large capacity of the bill storage space (it is not possible to reserve a large number of bills to store) due to the existence of the pushing mechanism.

Accordingly, there are required a bill handling machine and bill storage unit enabling correction of a fold and the like of a bill in a simple structure inexpressibly with high bill storage efficiency.

BRIEF SUMMARY OF THE INVENTION

An aspect of the invention provides a bill storage unit comprised of a bill storage portion to store bills that has an installation area to install a bill validator which takes in a bill to validate validity of the bill, a feeding device that feeds the bill delivered from the bill, validaor to the bill storage portion along a predetermined feeding path, and a correcting device which is formed of at least part of the feeding device and corrects a fold of the bill by applying a bending force to bend the bill to the bill while holding the bill on at least part of the feeding path.

Further, another aspect of the invention provides a bill handling machine comprised of a bill validator having a bill validating portion that validates validity of a bill inserted in a bill insertion slot, and a bill moving device that feeds a bill judged as being valid to a predetermined position, while feeding a bill judged as being invalid back to the bill insertion slot, and of a bill storage unit which has a bill guide inlet provided at the predetermined position to store the bill delivered from the bill validator, and which is provided with a bill storage portion to store bills that has an installation area to install the bill validator, a feeding device that feeds the bill delivered from the bill validator to the bill storage portion along a predetermined feeding path, and a correcting device which is formed of at least part of the feeding device and corrects a fold of the bill by applying a bending force to bend the bill to the bill while holding the bill on at least part of the feeding path.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out hereinafter.

BRIEF DESCRIPTION OF THE SEVERAL VIEWS OF THE DRAWING

The accompanying drawings, which are incorporated in and constitute a part of the specification, illustrate embodiments of the invention, and together with the general description given above and the detailed description of the embodiments given below, serve to explain the principles of the invention.

DETAILED DESCRIPTION OF THE INVENTION

One embodiment of a bill handling machine according to the present invention will specifically be described below with reference to accompanying drawings. In addition, as shown in FIG. 1, the bill handling machine according to the invention is capable of being incorporated into an inter-machine apparatus (the so-called sandwich apparatus) 210 installed adjacent to a slot machine 200 that is a game machine, for example.

Figure 2:
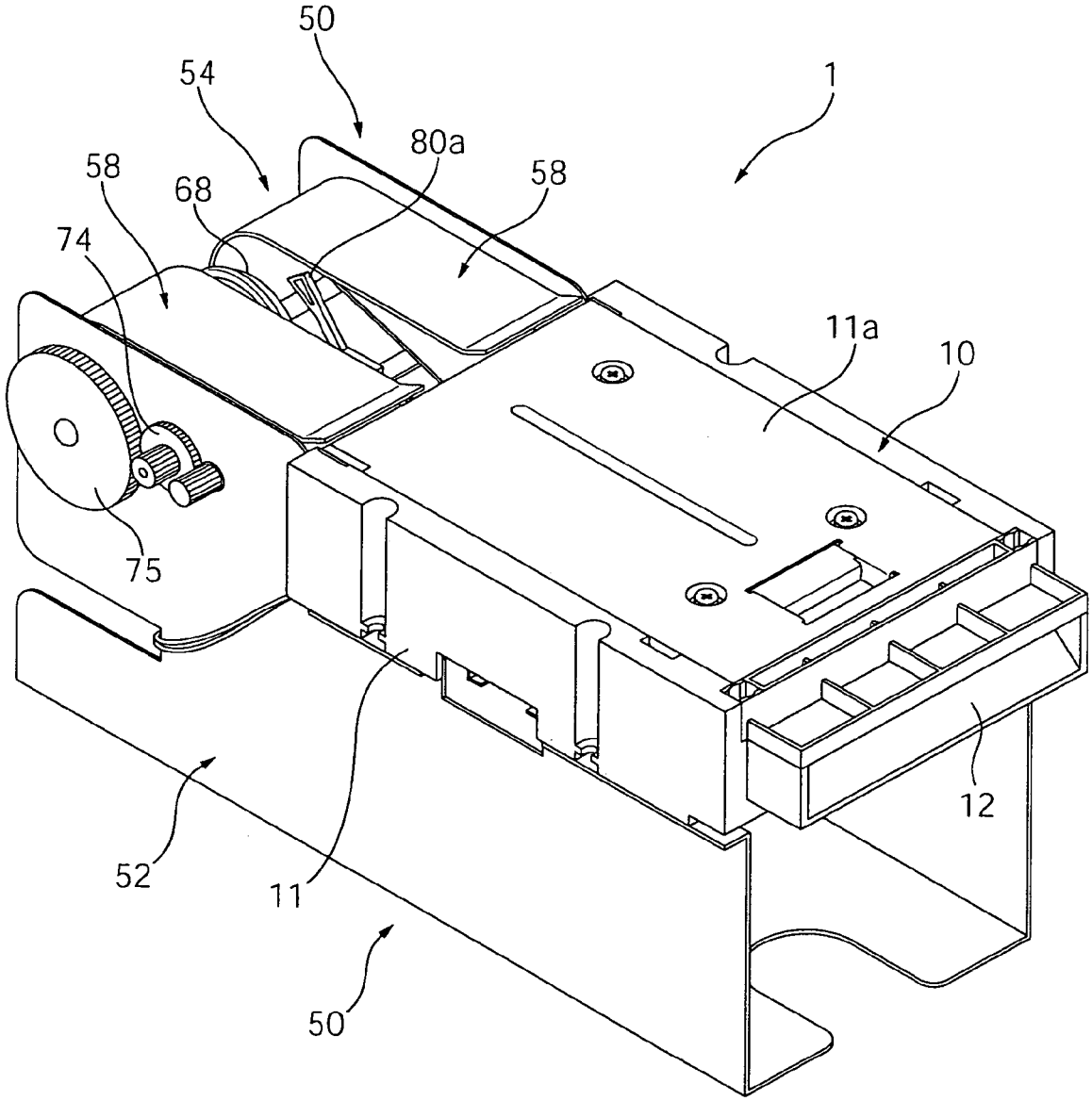
FIG. 2 is a view showing an entire configuration of the bill handling machine.
Figure 3:
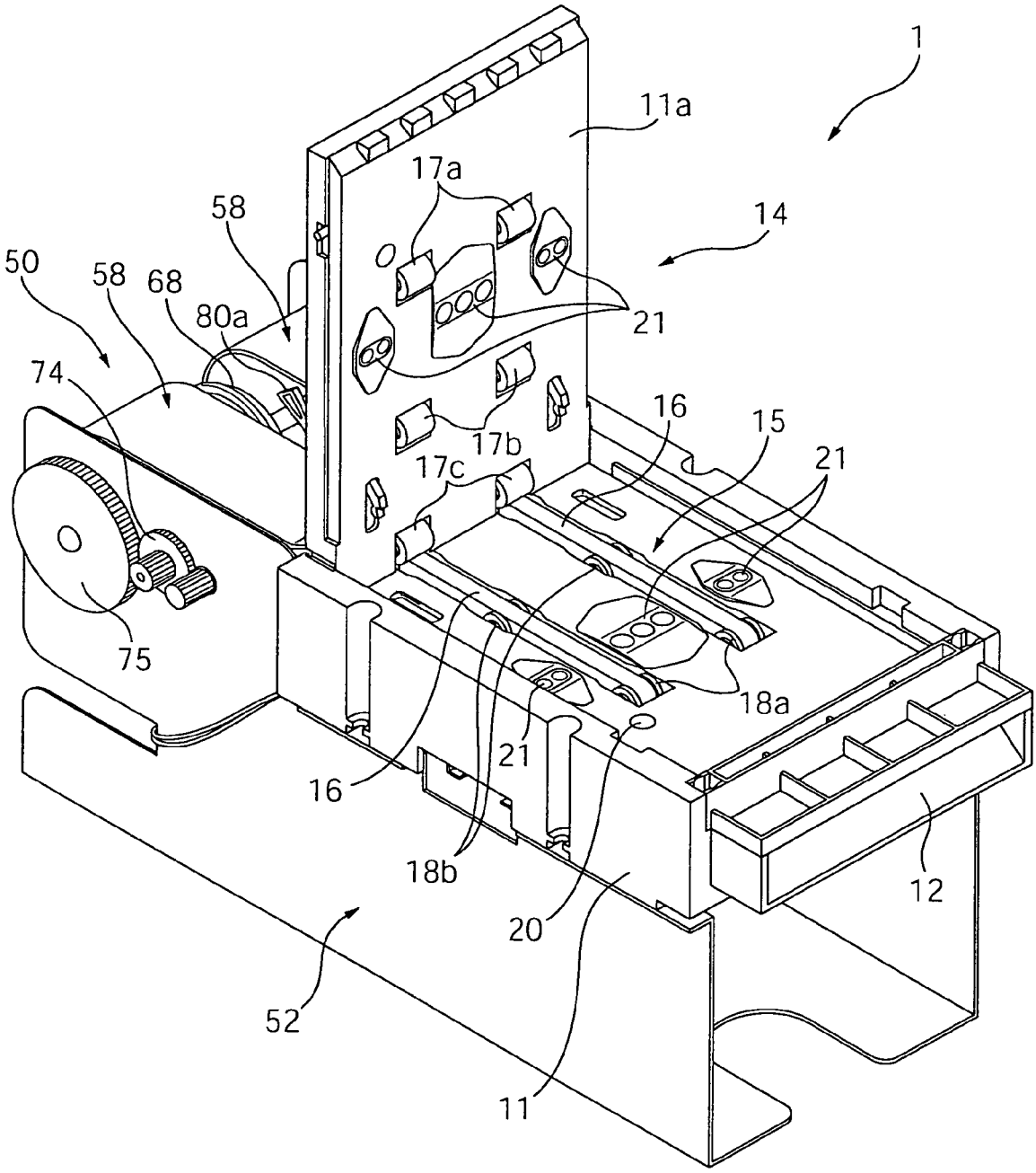
FIG. 3 is a view showing a configuration of a bill validator installed in the bill handling machine.
Figure 4:
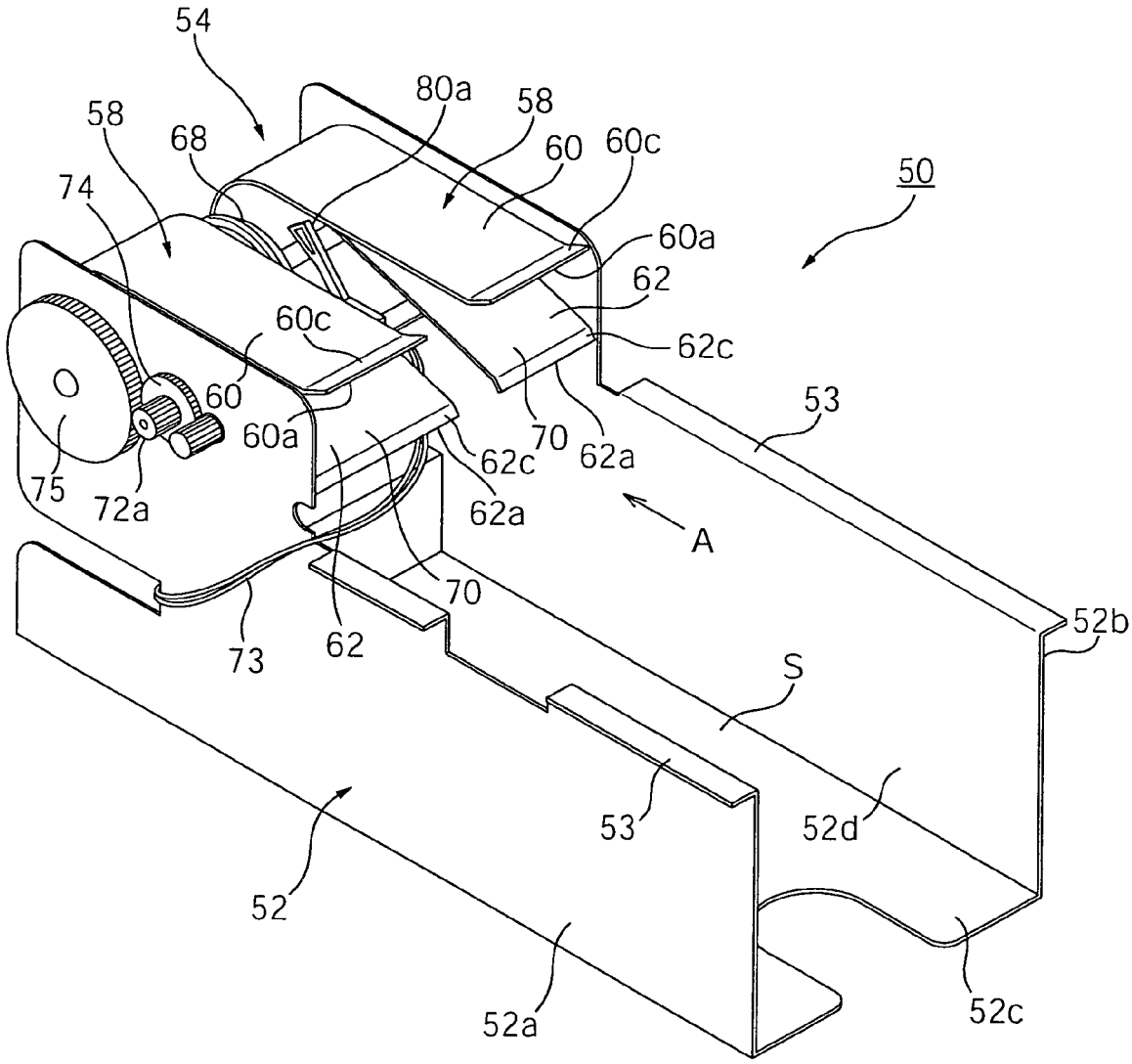
FIG. 4 is a view showing a configuration of a bill storage unit.

FIGS. 2 to 5 are views showing a configuration of a bill handling machine 1 incorporated into the inter-machine apparatus 210. FIG. 2 is a view showing an entire configuration of the bill handling machine 1. FIG. 3 is a view specifically showing particularly a configuration of a bill validator 10 in the bill handling machine 1. FIG. 4 is a view showing a configuration of a bill storage unit 50. FIG. 5 is a view as seen in the direction of the arrow A of FIG. 4.

Figure 1:
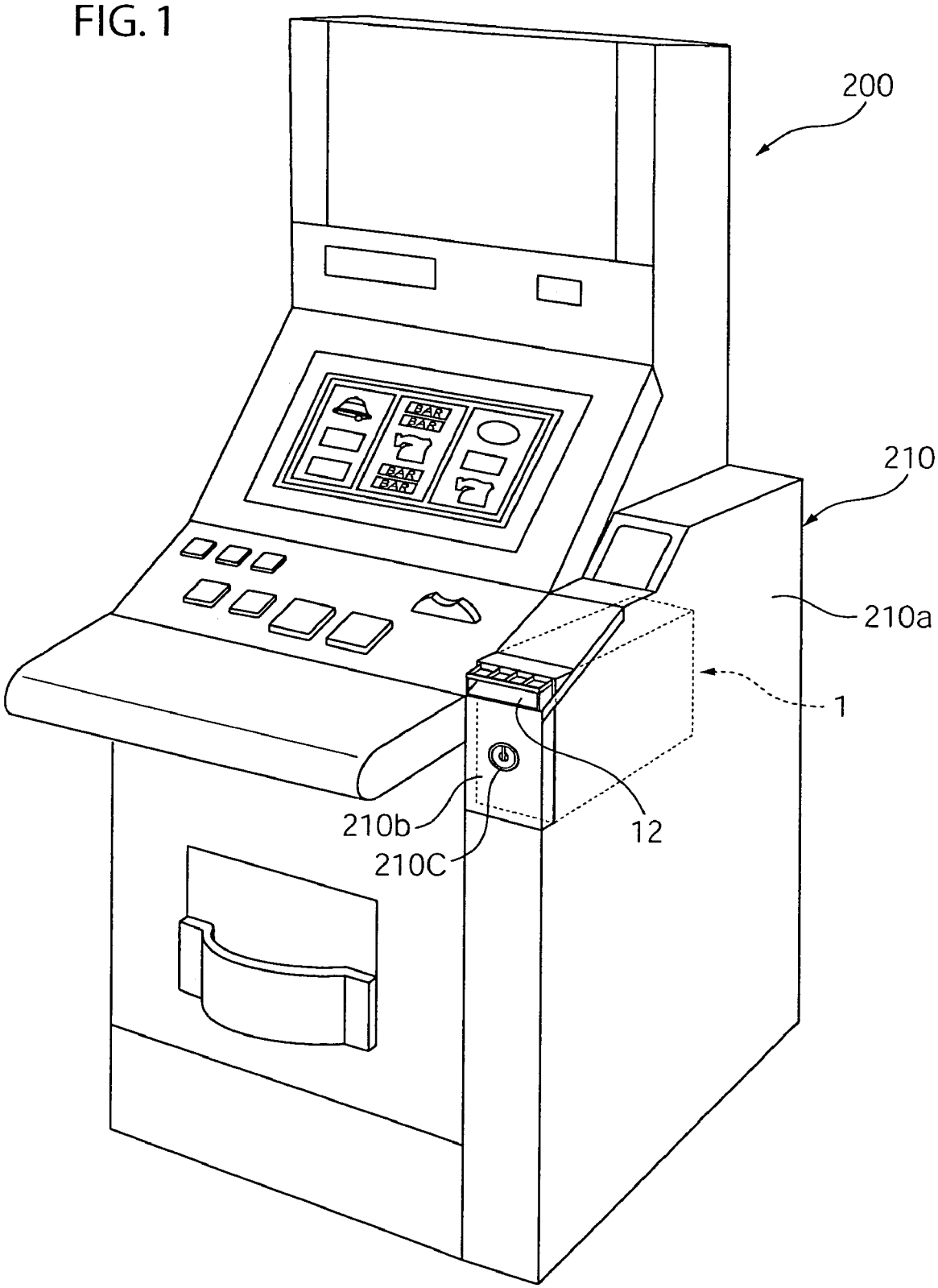
FIG. 1 is a view showing an example of installation of a bill handling machine, where the bill handling machine is installed in a slot machine that is a game machine.

Referring to FIGS. 1 to 3, described first are the bill handling machine, and the bill validator constituting part of the bill handling machine.

The bill handling machine 1 incorporated into the inter-machine apparatus 210 is held while being incorporated into a predetermined position by a fastening structure provided inside a frame 210*a* of the inter-machine apparatus 210, and a bill validator 10 constituting part of the bill handling machine 1 is connected electrically to a control apparatus that controls the game of the slot machine 200. An open/close door 210*b* to be opened and closed by a predetermined lock mechanism is supported rotatably on the front face of the frame 210*a*, and opening the open/close door 210*b* enables bills stacked and stored in a bill storage unit described later to be taken off the unit. In addition, the lock mechanism is locked and released by inserting a predetermined key in a key hole 210*c*.

The bill handling machine 1 is comprised of the bill validator 10 that validates the validity of a bill, and a bill storage unit 50 that is a base in which the bill validator 10 is installed. In this case, the bill validator 10 may be detachable with respect to the bill storage unit 50, or may be assembled and integrated beforehand with the unit 50.

The bill validator 10 has a main body 11 formed in substantially box-shape as a whole, and a rectangular bill insertion slot 12 to insert a bill is formed at the front face of the main body 11. Inside the main body 11 is installed a bill validating portion 14 that is bill validating means for validating the validity of the bill inserted from the bill insertion slot 12. The bill validating portion 14 is provided with bill feeding means (bill moving device; bill moving means) 15 that moves the bill with respect to the bill validating portion 14. As shown in the figure, the bill feeding means 15 is provided at the lower face side of a cover member 11*a* opened/closed with respect to the main body 11 and at the upper face side of the main body 11, and is comprised of two feeding belts 16 extending along the feeding direction on the surface portion of the main body 11, and a plurality of feeding roller pairs, 17*a*, 17*b* and 17*c*, which are supported rotatably at the lower face side of the cover member 11*a* and come into contact with the feeding belts 16 successively along the feeding direction. The feeding belts 16 are wound around a driving roller pair 18*a* driven and rotated by a driving motor 30 (see FIG. 10) that is a driving source, and a plurality of support roller pairs 18*b* (one pair is only shown in the figure) supported rotatably with respect to the main body 11, and cause friction (feeding force) between the belts and the plurality of feeding roller pairs, 17*a*, 17*b* and 17*c*, coming into contact with the belts to feed a bill. In this case, the bill feeding means 15 has the function of feeding a bill to the bill storage unit 50 (described later) side or feeding a bill back to the bill insertion slot 12 side by the driving motor 30 being rotated forwardly or reversely, respectively.

The bill feeding means 15 is installed to be positioned on the same plane as a bill guide plane of the bill insertion slot 12, and a bill outlet (not shown) is provided downstream of the means 15. A bill is conveyed by the bill feeding means 15 while being validated on its validity in the bill validating portion 14, and fed to the bill storage unit 50 side via the bill outlet. The feeding force for the bill caused by the bill feeding means 15 is set stronger than the initial feeding force (friction generated between a bill that is not held by a guide plate 60 and feeding roller 68 and the feeding roller 68 as described later) of the feeding roller installed at the bill storage unit 50 (described later) side.

Figure 10:
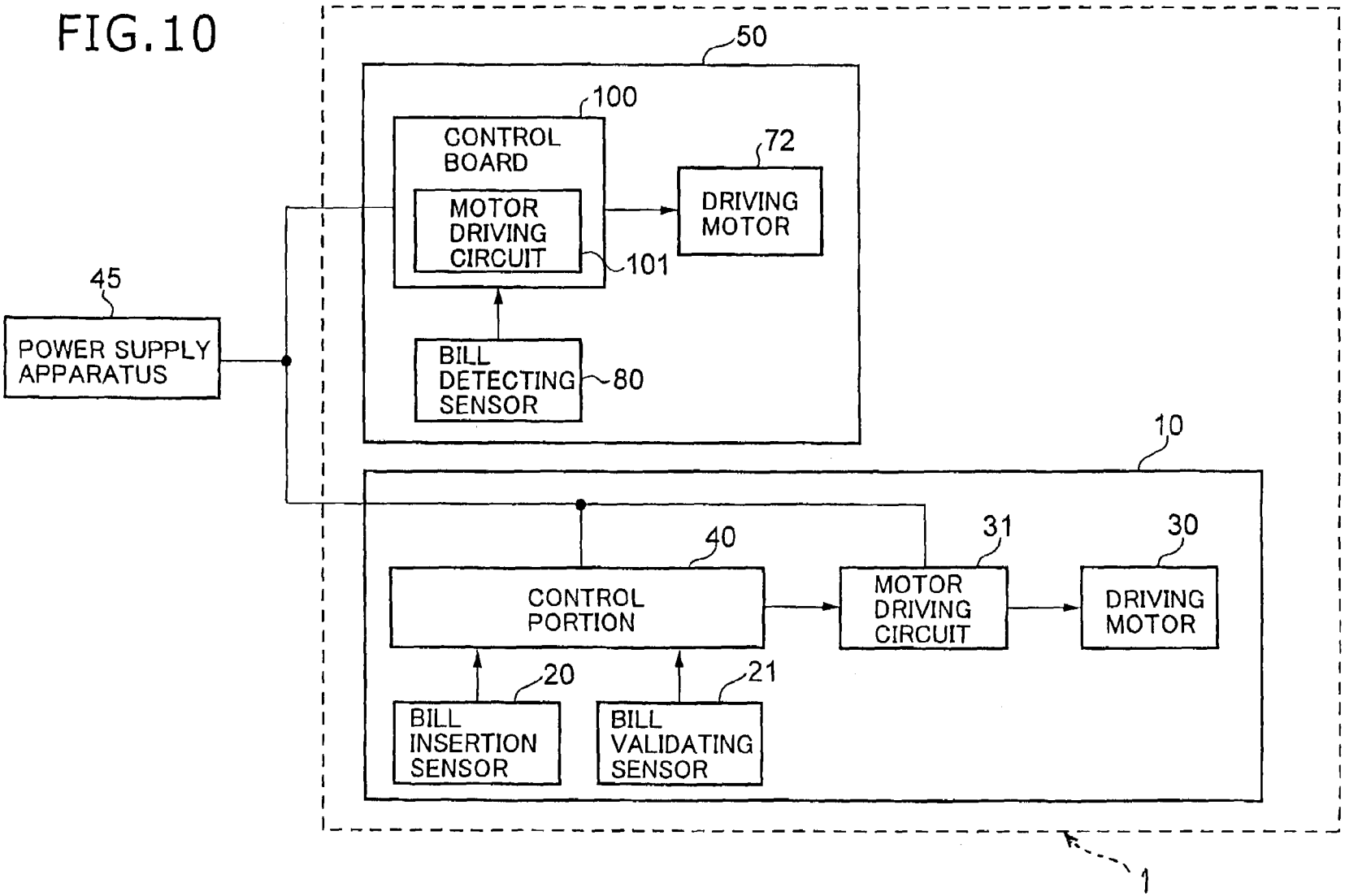
FIG. 10 is a block diagram showing an example of a control apparatus that controls the operation in the bill handling machine.

In the bill validating portion 14, along the feeding direction are installed a bill insertion sensor 20 having the function of detecting insertion of a bill from the bill insertion slot 12, and a bill validating sensor 21 having the function of validating the validity of the inserted bill. As shown in FIG. 10, the bill insertion sensor 20 and bill validating sensor 21 are connected to a control portion 40 provided with a CPU, memory device and the like, and based on detection signals from the sensors 20 and 21, driving of the driving motor 30 is controlled through a motor driving circuit 31. In addition, the CPU compares data on an authorized bill beforehand stored in the memory device with detection data detected by the bill validating sensor 21, and validates the validity of the bill.

The control portion 40 and driving motor 30 in the bill validator 10 are configured not to transmit and receive signals on the feeding and type of bill to/from the bill storage unit 50 described later. The validation of a bill and driving of the driving motor 30 is controlled by power supplied from a predetermined power supply apparatus 45. In other words, the bill validator 10 does not transmit nor receive signals on information of a type of bill, feeding of the bill and the like to/from the bill storage unit 50, and thus executes the control by itself. In addition, as described previously, the control portion 40 of the bill validator 10 may be configured to communicate signals on a type of bill and the like with the game apparatus that controls the game of the slot machine 200 so that the credit for the game is executed at the slot machine side corresponding to the signals.

Referring to FIGS. 4 and 5, described next is a configuration of the bill storage unit 50 in which the bill validator 10 is installed detachably. In addition for the sake of convenience, it is assumed hereinafter on the direction that a side where the bill insertion slot 12 of the bill handling machine 1 is located is a front side, a side opposed to the front side is a rear side, a side where the bill validator 10 is located is an upper side, and that a side (where a bill storage space S described later is located) opposed to the upper side is a lower side.

As shown in FIGS. 4 and 5, the bill storage unit 50 has a substantially box-shaped bill storage portion 52 (bill storage means) to stack bills B vertically to store, and a feeding mechanism (feeding device; feeding means) 54 that feeds a bill B delivered from the bill validator 10 toward the bill storage portion 52.

The bill storage portion 52 forms the bill storage space S to store the bill B with a pair of side plates 52*a* and 52*b*, and a bottom plate 52*c* that connects the side plates 52*a* and 52*b*, and has openings at the upper portion and front portion. In this case, a front opening 52*d* forms an outlet to take off bills B stacked and stored in the bill storage space S, and the bills B are taken off by opening the open/close door 210*b* as shown in FIG. 1. An upper end face of each of the side plates 52*a* and 52*b* extends sideward by a predetermined width, and forms a support plane 53 (installation area for the bill validator) to support the bill validator 10 from under the validator 10.

Meanwhile, the feeding mechanism 54 has a pair of guide portions 58 as guide means for guiding a bill B fed out of the bill validator 10 into the bill storage space S of the bill storage portion 52, and a feeding roller 68 as a feeding rotation member disposed at a predetermined position between the guide portions 58. In this case, the pair of guide portions 58 cooperate to form a feeding path that couple the bill outlet of the bill validator 10 to the bill storage space S situated under the bill validator 10 in the shape of a half loop or semi-circle. The guide portions 58 are spaced apart from each other and located at both sides of the feeding path to guide the bill B while supporting both sides of the bill B.

More specifically, each guide portion 58 is comprised of a pair of guide plates 60 and 62 respectively situated at upper and lower positions. In this case, a guide inlet (bill guide inlet) 70 to receive the bill B delivered from the bill outlet is located between one end 60*a* of the upper guide plate 60 opposed to the bill outlet of the bill validator 10 and one end 62*a* of the lower guide plate 62. Further, in order for a bill B to be guided to the guide inlet 70 smoothly without any trouble, slanting faces 60*c* and 62*c* are located on ends 60*a* and 62*a* of the upper and lower guide plates 60 and 62, respectively.

The upper guide plate 60 extends backward from one end 60*a* thereof by a predetermined length, while turning back forward in the shape of a semi-loop (in substantially a U-shape), and is located at a forward position with the other end 60*b* (see FIG. 5) opposed to the bill storage space S. Meanwhile, the lower guide plate 62 extends backward from one end 62*a* thereof, obliquely upward by a predetermined length, and terminates with the other end 62*b* (see FIG. 5) without turning back. In this case, a position of the other end 62*b* is set such that the end portion of the bill B guided by the lower guide plate 62 comes into contact with the upper end of the feeding roller 68 at the time of reaching the other end 62*b*.

The feeding roller 68 arranged between the pair of guide portions 58 is comprised of a roller body 68*a* made of metal, for example, and a contact ring 68*b* made of rubber, for example, to come into contact with the bill B. Further, the feeding roller 68 is fixed to a rotation axis 76 (see FIG. 5), and opposite ends of the rotation axis 76 are supported rotatably with respect to the side plates 52*a* and 52*b* of the bill storage portion 52.

Figure 5A:
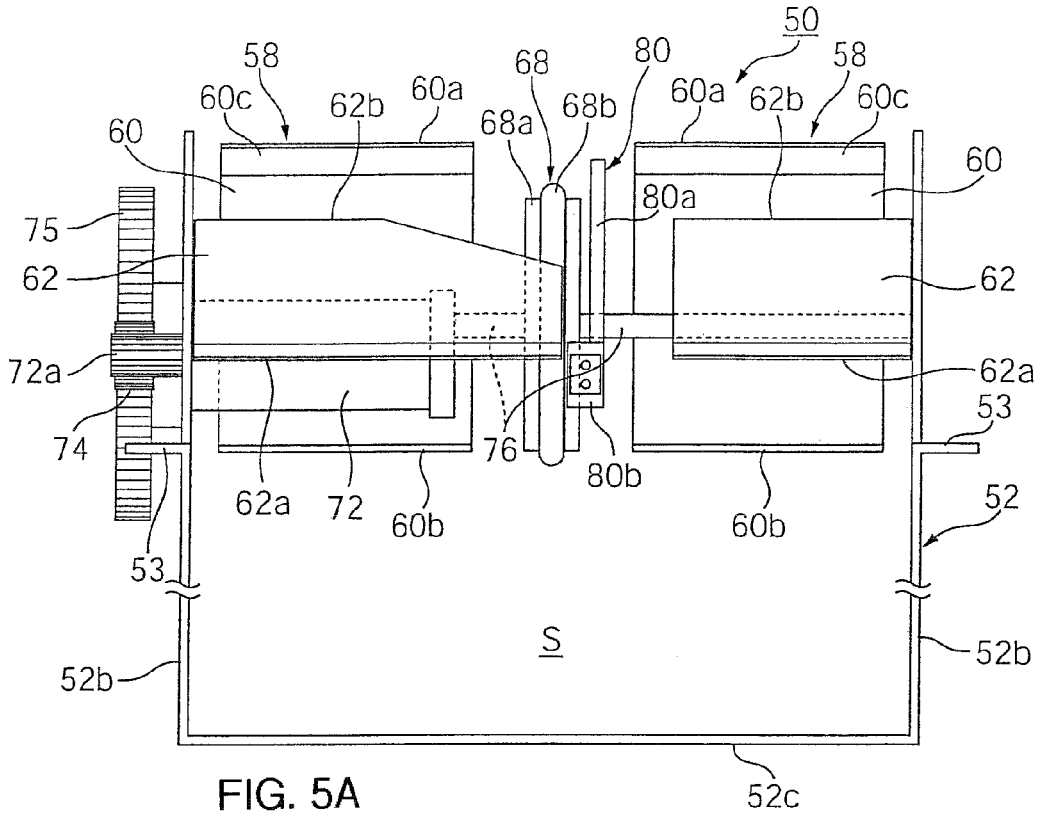
FIG. 5A is a view as seen in the direction of the arrow of FIG. 4.
Figure 5B:
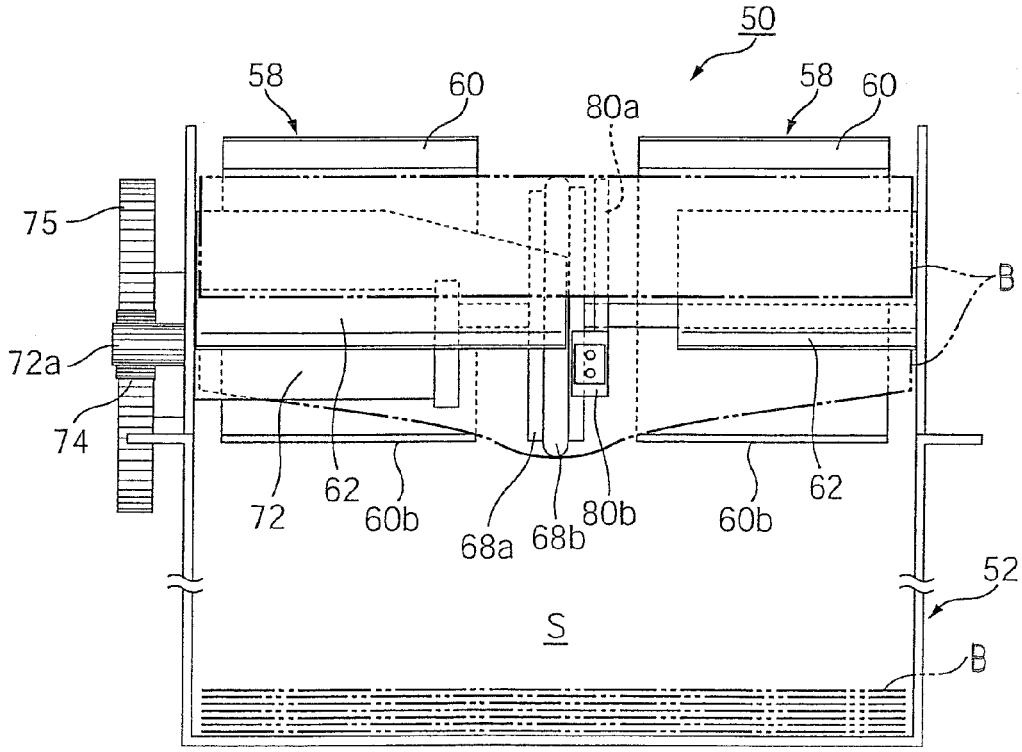
FIG. 5B is a view showing the bill storage unit storing bills in a state as shown in FIG. 4A.

In this embodiment, the feeding roller 68 is located to have a predetermined positional relationship with the other ends 60*b* sides of the upper guide plates 60 of the pair of guide portions 58. More specifically, as shown in FIG. 5A, the lower end of the feeding roller 68 is positioned to protrude under the other ends 60*b* sides of the upper guide plates 60, and by this means, as shown in FIG. 5B, the bill B passed through the lower end of the feeding roller 68 is held between the other ends 60*b* sides of the upper guide plates 60 and the feeding roller 68 while being bent in substantially V-shape. In addition, in this embodiment, in order to increase the bending force to apply to the bill B, a width of the contact ring 68*b* is set smaller than a width of the roller body 68*a*.

Further, as clearly shown in FIGS. 5A and 5B, a driving motor 72 to drive and rotate the feeding roller 68 is disposed under the lower guide plate 62 of one of the guide portions 58. A first gear 74 with a small diameter is fixed to one end of a rotation driving axis 72*a* of the driving motor 72. The first gear 74 is engaged with a second gear 75 with a large diameter fixed to one end of the rotation axis 76 of the feeding roller 68, and the rotation force of the motor 72 is whereby reduced by a predetermined gear ratio and conveyed to the feeding roller 68.

In addition, in this embodiment, specifications of the motor 72, friction coefficient of the contact ring 68 and the like are set so that the initial feeding force for the bill B by the feeding roller 68 is lower than the feeding force for the bill B by the bill feeding means of the bill validator 10.

A bill detecting sensor 80 is disposed in a predetermined position between the pair of guide plates 58 (in this embodiment, between the lower guide plates 62 of the pair of guide plates 58) and serves as bill detecting means (bill detecting portion) for detecting the bill B delivered from the bill outlet of the bill validator 10. The bill detecting sensor 80 is supported from under the sensor by a support member extending from one of the side plates 52*b*, for example, and is comprised of a movable detecting member 80*a* that rotates by coming into contact with the bill B, and a sensor body 80*b* that detects rotation of the movable detecting member 80*a* to generate a detection signal.

The sensor body 80*b* is electrically connected to a control board 100 installed with a motor driving circuit 101 fixed to the bill storage unit 50 (see FIG. 10), via a signal line 73. The control board 100 performs control to drive the driving motor 72 only for a period during which the board 100 receives the detection signal from the sensor body 80*b*. In other words, in this embodiment, the driving roller 68 is driven and rotated in the direction of feeding the bill to the bill storage space S only for a period during which the movable detecting member 80*a* is rotated from an initial position as shown in FIG. 4 (during which the bill B maintains contact with the movable detecting member 80*a*). The control board 100 receives power supply from the power supply apparatus 45, and performs control of rotating the feeding roller 68 only when the bill detecting sensor 80 detects the presence of the bill B, but does not transmit or receive a signal for the type of bill or feeding of the bill to/from the bill validator 10.

The operation of the bill handling machine 1 with the aforementioned configuration will be described below with reference to FIGS. 3 and 6 to 10. In addition, FIGS. 6 to 8 omit the cover member 11*a* of the bill validator 10.

Figure 6:
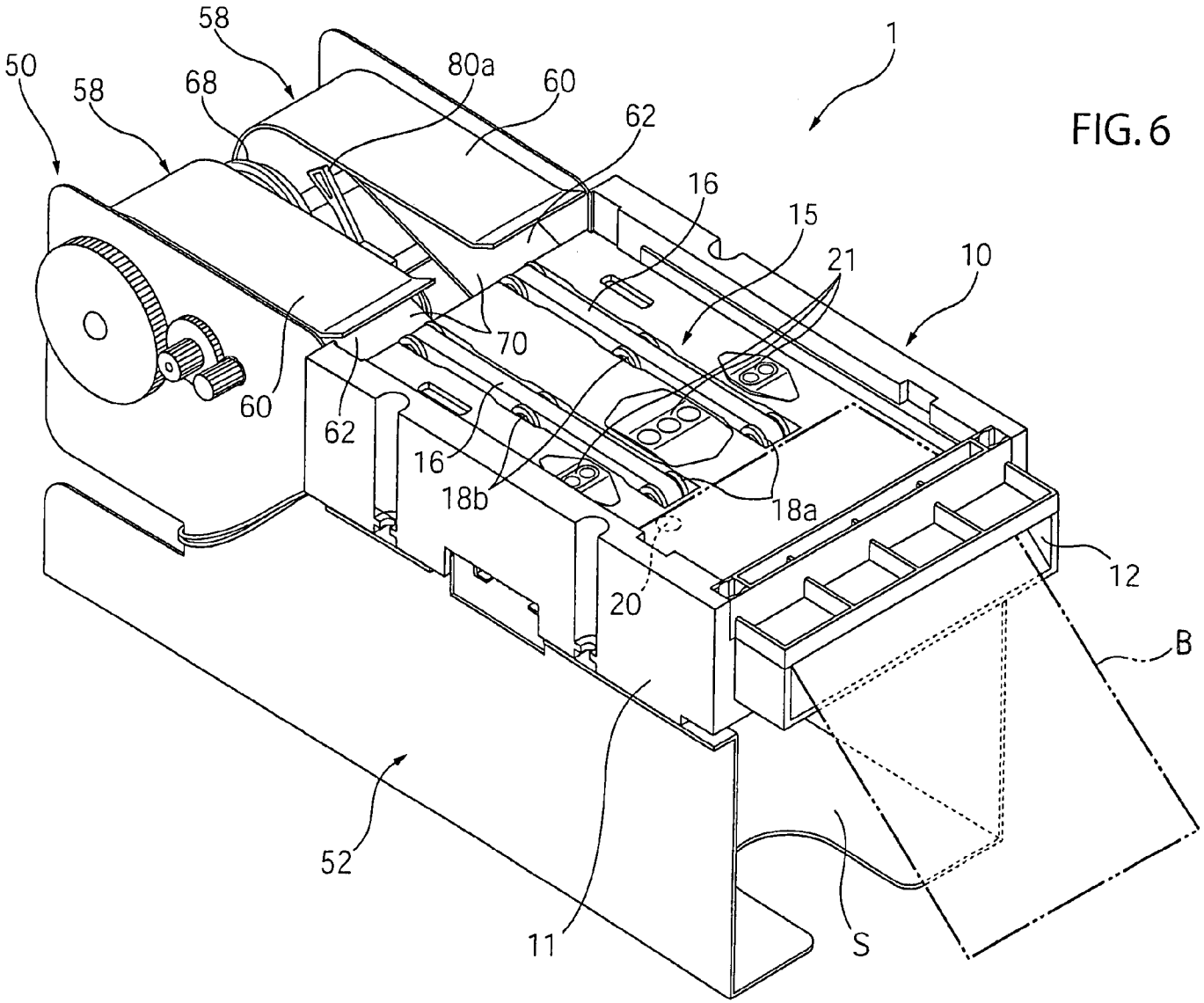
FIG. 6 is a view showing a state where a bill is inserted in the bill validator.
Figure 7:
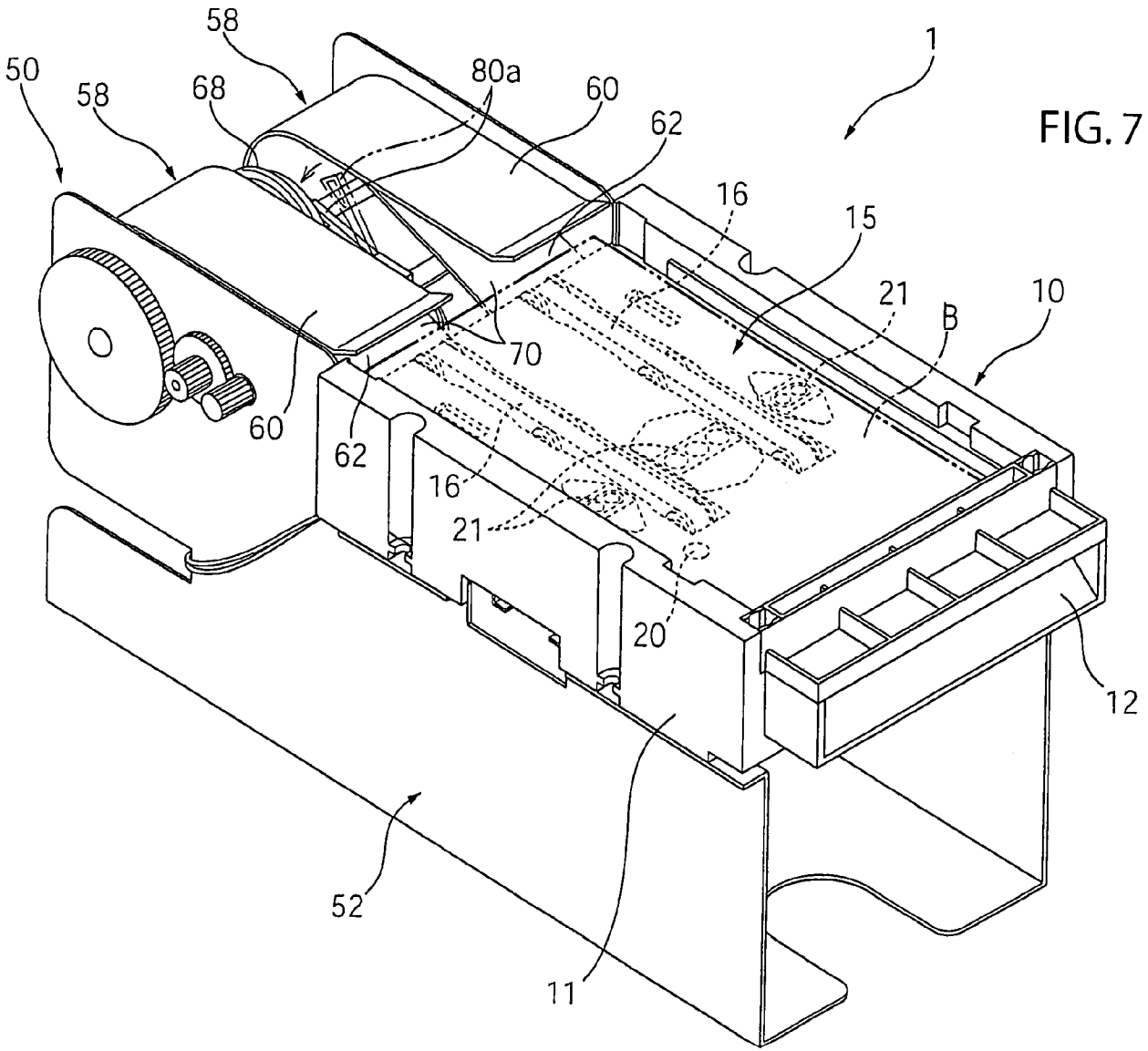
FIG. 7 is a view showing a state where the bill is being validated in the bill validator.

As shown in FIG. 6, when a bill B is inserted in the bill insertion slot 12 of the bill validator 10, the bill insertion sensor 20 detects a front end of the bill B, and the driving motor 30 constituting part of the bill feeding means 15 is driven and rotated. By rotation driving of the bill feeding means 15, the bill B is fed to the bill storage unit 50 while being held by the feeding belts 16 and the plurality of feeding roller pairs 17*a*, 17*b* and 17*c* coming into contact with the belts 16. At the time of feeding the bill, the bill validating sensor 21 transmits a detection signal obtained from the bill to the control portion 40, and the control portion 40 compares the signal with data on the authorized bill, and validates the validity of the bill. Validation of the validity of the bill is executed by detecting the longitudinal direction of the bill for a period during which the bill B is conveyed as shown in FIGS. 6 to 8.

For a period during which the bill B is fed by the bill feeding means 15 and validated, the front end of the bill B is guided to the guide inlet 70 of the bill storage unit 50 while being delivered from the bill outlet, and then comes into contact with the movable detecting member 80*a* of the bill detecting sensor 80. At this point, the movable detecting member 80*a* moves downward as shown by the arrow in FIG. 7 due to the weight of the bill. By this means, the detection signal from the sensor body 80*b* is transmitted to the control board 100, and the driving motor 72 is driven and rotated in the bill-feeding direction. In other words, when the bill B is validated as being valid, the bill B is fed to the bill storage space S from the guide inlet 70 via pairs of upper and lower guide plates 60 and 62 on the right and left, by rotation of the feeding roller 68 due to rotation of the driving motor 72 and by rotation driving of the bill feeding means 15 in the feeding direction. At this point, in the stage where the bill B is passed through the lower end of the feeding roller 68, the bill B is fed while being held in a state of being bent in substantially a V-shape between the other ends 60*b* of the upper guide plates 60 and the feeding roller 68(see FIGS. 5B and 9), and folds and the like are removed. In other words, the bill B is restored to a flat state. Thus, in this embodiment, the feeding roller 68 and upper guide plates 60 cooperate to form correcting means (correcting device) for removing a fold in the bill B by applying the bending force to stretch the bill B while holding the bill B substantially in an end region of the feeding path (substantially the end position of the semi-loop part which is part of the feeding path). In addition, as can be seen from the explanations and drawings described previously, the correcting means is located adjacent to the bill storage space S (bill storage portion 52).

Figure 12A:
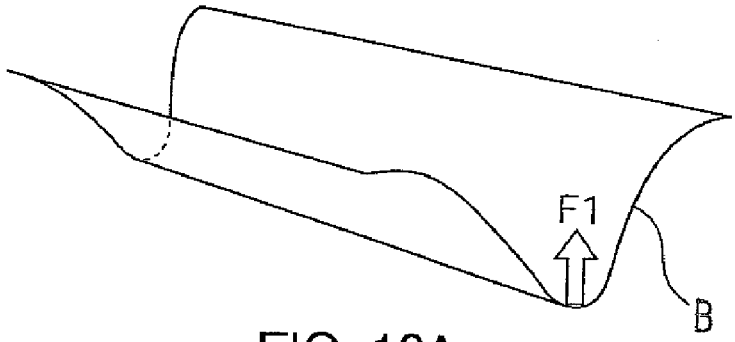
FIGS. 12A and 12B are views showing comparison of a horizontal restoring force of a bill between horizontal feeding and semi-loop-like feeding of the bill.
Figure 12B:
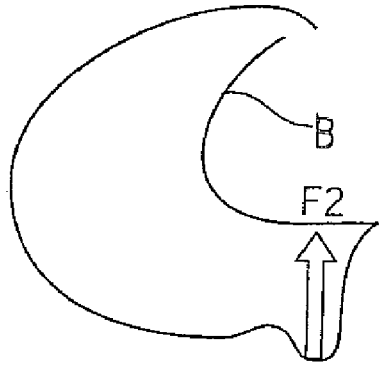

In addition, it is very effective in applying the bending force to the bill B by the correcting means while feeding the bill B bent in the semi-loop shape, as in this embodiment. In other words, when the correcting means applies the bending force to the bill B while the bill B is fed in a semi-loop shape as shown in FIG. 12B, force F2 (that is the force against the bending force) such that the bill B is restored to a flat state from the bent state is larger than the force (force F1 such that the bill B is restored to a flat state from the bent state) in the case of applying the bending force to the bill while feeding the bill in its flat state as shown in FIG. 12 A. Therefore, the correcting effect is remarkably improved.

Figure 8:
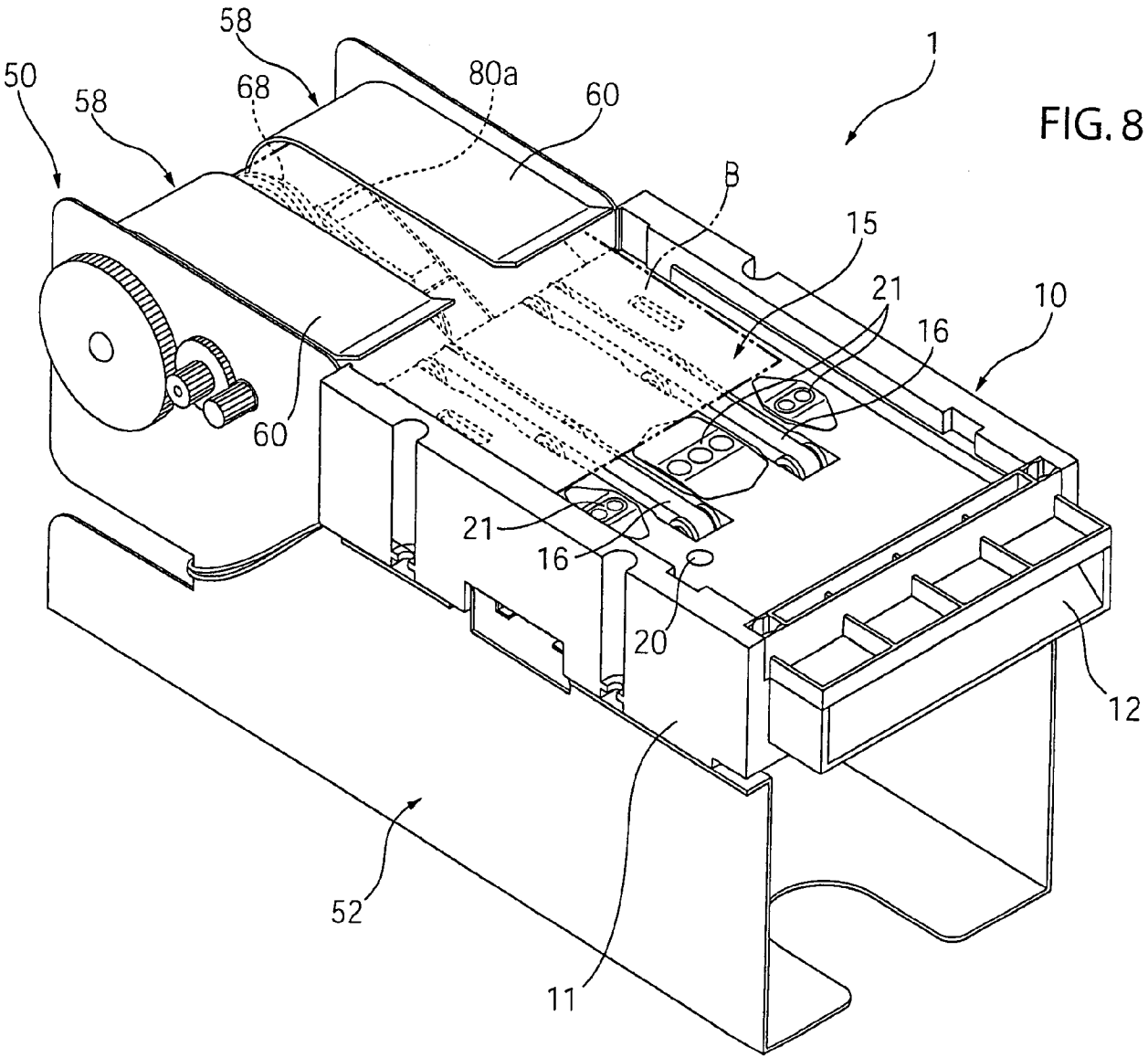
FIG. 8 is a view showing a state validation of the bill is finished in the bill validator.
Figure 9:
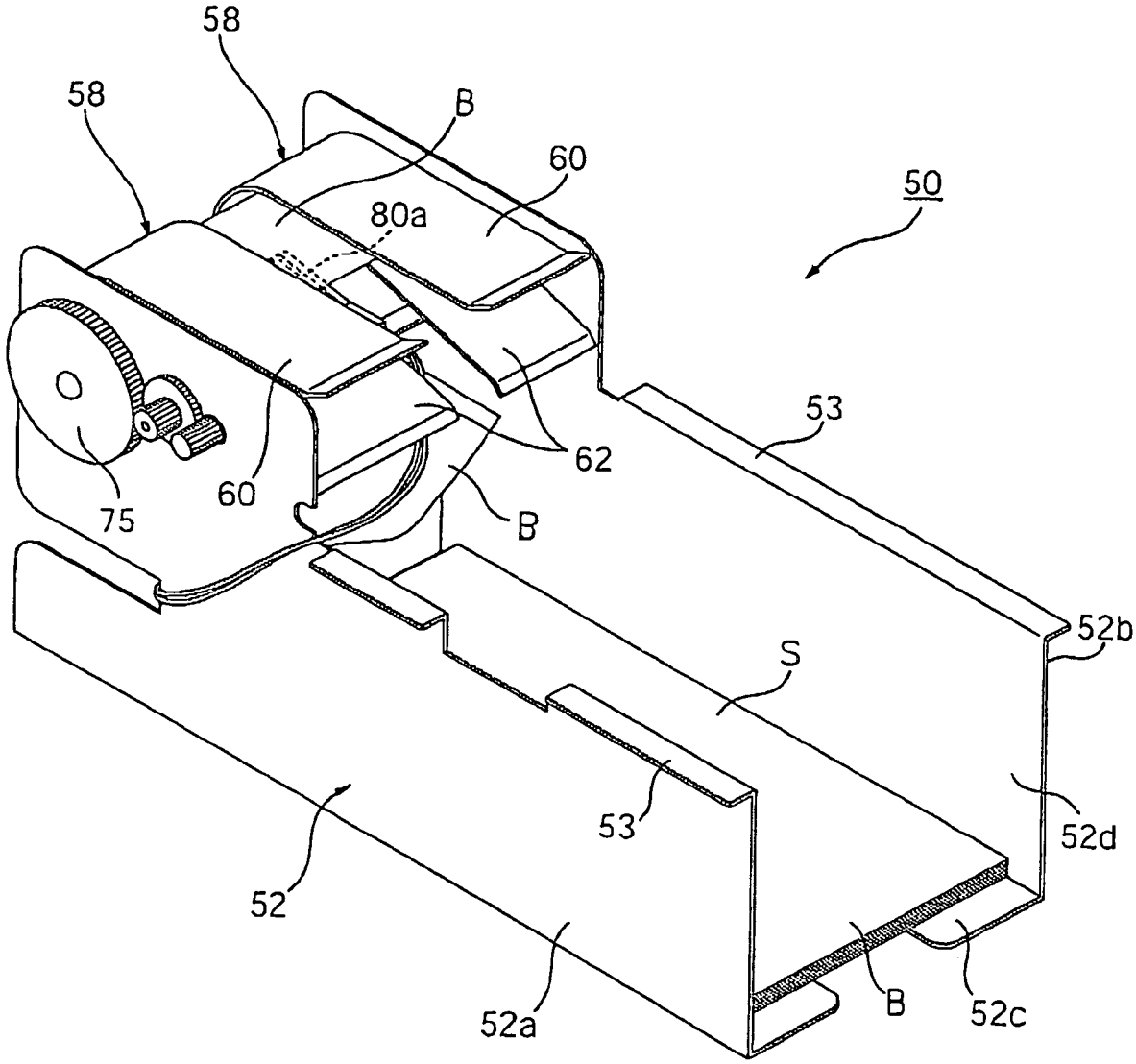
FIG. 9 is a view showing the bill storage unit storing bills in a bill storage space.
Figure 11A:
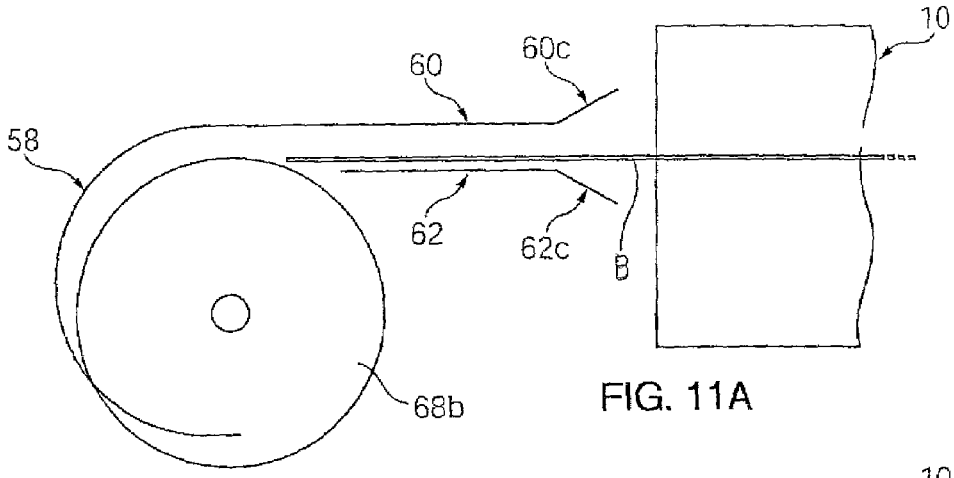
FIGS. 11A to 11C are schematic views stepwise showing feeding of a bill by a feeding mechanism.
Figure 11B:
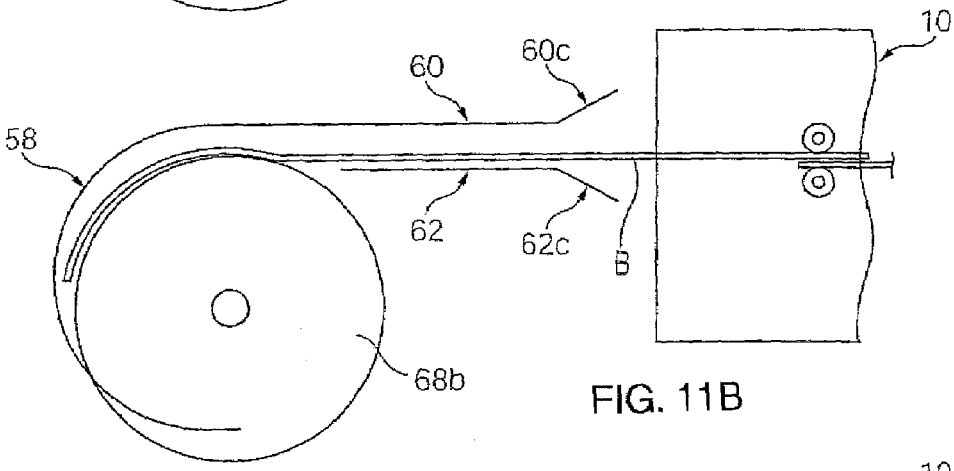
Figure 11C:
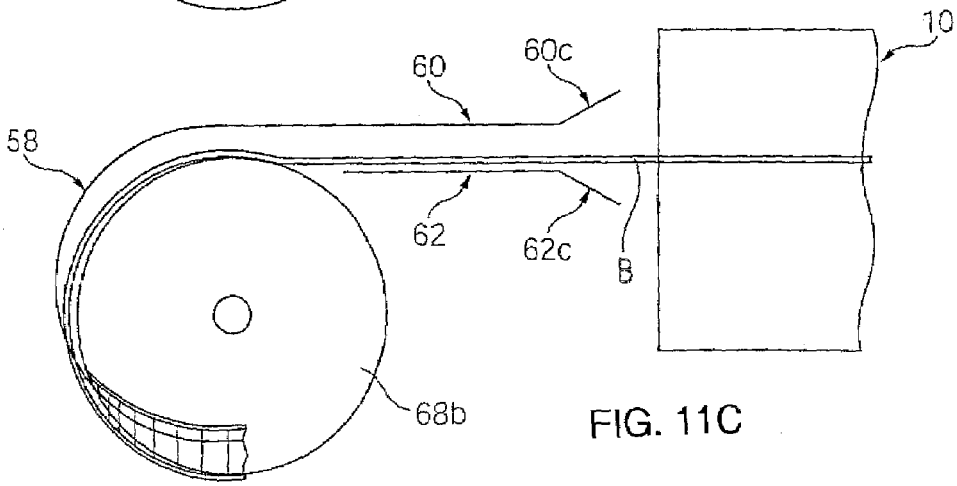

Meanwhile, when the validity of the inserted bill B is not validated, the driving motor 30 of the bill feeding means 15 is once halted in a state as shown in FIG. 8, and then, driven reversely. By this means, the bill B not validated as being valid is returned to the bill insertion slot 12. At this point, as described previously, since the feeding force of the bill feeding means 15 is set larger than the initial feeding force by the feeding roller 68, even in a state where the movable detecting member 80*a* moves downward as shown by the arrow in FIG. 7 and the feeding roller 68 is driven and rotated, the bill B can be returned by the bill feeding means 15 without being fed to the bill storage space S. It is noted that only the initial feeding force by the feeding roller 68 is smaller than the feeding force by the bill feeding means 15. In other words, the feeding force (initial feeding force) by the feeding roller 68 is smaller than the feeding force of the bill feeding means 15 when the bill B is not fully wound around the feeding roller 68 as shown in FIGS. 11A and 11B. Then, in the stage where the bill B is fully wound around the feeding roller 68 as shown in FIG. 11C or the correcting means starts applying the bending force to the bill B, the feeding force by the feeding roller 68 exceeds the feeding force of the bill feeding means 15, and enables reliable feeding of the bill and effective application of correction.

As described above, in this embodiment, the feeding roller 68 and upper guide plates 60 form the correcting means for correcting a fold of the bill B, in other words, the fold of the bill B is corrected using the feeding mechanism 54 in an already-existing manner. Therefore, the need is eliminated of separately providing a complicated pushing mechanism as disclosed in Patent Document 1. Accordingly, the structure can be simplified, and it is possible to simplify the assembly operation and reduce the manufacturing cost. Further, by such existence of the correcting means due to the feeding mechanism 54, even when the bill B delivered from the feeding path is stored in the bill storage portion 52 without any other operation, the clearance is not formed between bills in the bill storage portion 52, and it is possible to stack bills B in good shape in the bill storage portion 52 to store efficiently. The need is whereby eliminated of providing another mechanism such as the pushing mechanism in the bill storage portion 52 and the like. Accordingly, corresponding to such eliminated need, it is possible to reserve a large capacity of the bill storage space S.

Further, in this embodiment, the correcting means bends the bill B in substantially V-shape in the direction perpendicular to the feeding direction. Specifically, the guide portion 58 is comprised of a pair of guide plates 60, 60 (62, 62) which are spaced opposed to each other on a single plane to form a guide plane that comes into contact with the bill to guide the bill B, and the feeding rotation member 68 has an end portion that is positioned between the pair of guide plates 60, 60 while crossing the single plane substantially perpendicularly so as to hold the bill B being fed with the pair of guide plates 60, 60 while bending the bill B. Therefore, the correcting means is able to bend the bill B efficiently and correct a fold of the bill B effectively.

Furthermore, according to this embodiment, since the feeding path constitutes a semi-loop-like shape and the correcting means is located at substantially the end position of the semi-loop part, it is possible to apply the bending force to the bill B effectively and remove a fold from the bill B efficiently, and further, it is also possible to increase the feeding force for the bill B effectively. Moreover, when the bill B undergoes the bending force by the correcting means while being bent and fed in a semi-loop shape, the force (against the bending force) such that the bill B is restored to a flat state from the bent state is larger than that in the case where the bill B undergoes the bending force while being fed in a horizontal state, and the correcting effect is remarkably improved.

Moreover, in this embodiment, since the bill storage portion 52 is situated adjacent to the correcting means and the bill B is placed successively to be stacked, it is possible to store the bill B with the fold corrected efficiently in the bill storage portion 52 while keeping the flat state of the bill.

Further, in this embodiment, the bill B inserted in the bill insertion slot 12 is validated on its validity by the bill validating means 14 of the bill validator 10. In this case, the bill B validated as being valid is fed to a predetermined position of the bill storage unit 50 by the bill feeding means 15. In the predetermined position is provided the bill detecting means 80 for detecting the bill B, and when the bill B is detected, the feeding roller 68 is driven and rotated to feed the bill B to the bill storage portion 52. By this means, the bill B validated as being valid is fed to the bill storage portion 52 by the bill feeding means 15 and rotation driving of the feeding roller 68. Meanwhile, when the bill detecting means 80 cannot judge the validity of the bill B, the bill feeding means 15 performs the operation of sending the bill B back (the bill feeding means 15 is driven reversely) to discharge the bill B to the bill insertion slot 12. At this point, since the feeding force for the bill B by the feeding roller 68 is set lower than the feeding force for the bill B by the bill feeding means 15, even when a front end portion of the bill B is in said predetermined position, and feeding roller 68 is driven and rotated, the bill B is returned to the bill insertion slot 12 by the bill feeding means 15 irrespective of rotation of the feeding roller 68.

Thus, with respect to feeding of the bill validated on its validity, the bill storage unit 50 is only required to simply detect the presence or absence of the bill B fed from the bill validator 10 and to drive and rotate the feeding roller 68 in the bill feeding direction when the bill is detected, whereby simplifying the control for feeding of the bill. Further, since a signal is not communicated between the bill validator 10 and bill storage unit 50, such work is not necessary for matching protocols of signal therebetween, and it is possible to install various types of bill validator 10 in the bill storage unit 50 and reduce the cost as the entire apparatus.

Furthermore, in this embodiment, the bill storage portion 52 successively places and stacks bills fed therein by the feeding roller 68. When the bills are thus placed and stacked successively in the bill storage portion 52 by the rotation driving of the feeding roller 68 without any other operation, it is possible to reduce structural elements as possible and simplify the structure of the bill storage unit.

In addition, the present invention is not limited to the aforementioned embodiment, and is capable of being carried into practice without departing from the scope of the subject matter thereof. For example, with respect to the feeding roller in the bill storage unit, a pair of rollers may be provided, or a plurality of rollers may be provided in the feeding direction. The bill detecting sensor that detects the presence of a bill may be comprised of an optical sensor other than a mechanical sensor. The guide plates to remove folds (creases) and the like of the bill are configured to bend the bill in substantially V-shape while causing the bill to loop, but three guide plates may be provided at respective positions in the horizontal direction to bend the bill in substantially W-shape to remove the folds (wrinkles) and the like. Further, in the above-mentioned embodiment, a pair of guide portions 58 are provided at respective sides not to interfere with the bill detecting sensor 80, but the pair of guide plates 58 may be formed of a single piece with a slit or the like formed in the single piece for the bill detecting sensor 80 to escape. Furthermore, in the above-mentioned embodiment, the roller 68 is used as a feeding rotation member, but any forms are available that are able to feed a bill by the rotation force. The correcting means comprised of the upper guide plates 60 and rotation roller 68 may be provided over the whole feeding path. Moreover, in the above-mentioned embodiment, the bill is fed along the longitudinal direction thereof and bent in substantially V-shape in the direction (generally, transverse direction perpendicular to the longitudinal direction of the bill) perpendicular to the feeding direction, but the correcting means is not limited to V-shape and may bend a bill in various shapes such as, for example, W-shape or wave-shape.

Additional advantages and modifications will readily occur to those skilled in the art. Therefore, the invention in its broader aspects is not limited to the specific details and representative embodiments shown and described herein. Accordingly, various modifications may be made without departing from the spirit or scope of the general inventive concept as defined by the appended claims and their equivalents.

What is claimed is:

1. A bill transport and storage unit comprising:

a bill storage portion for storing bills and that has an installation area for installing a bill validator which takes in a bill to validate the bill; and a bill feeding device defining a feeding path for a bill to travel to reach the bill storage device, the bill feeding device comprising:

a guide device including a pair of guides spaced from each other along a direction perpendicular to the feeding path traveled by a bill to reach the bill storage portion, each guide including a planar portion and an adjoining semi-loop portion, the guides being aligned so that the planar portions are co-planar and the semi-loop portions are coaxial; and a feeding rotation member disposed between the pair of guides, having an outer peripheral surface, and rotated about an axis generally parallel to the planar portions of the guides, wherein the outer peripheral surface protrudes outwardly from, between, and beyond the planar portions of the pair of guides to engage and feed a bill in the feeding path, by applying a first frictional force to the bill, so the bill is fed along the planar portions of the pair of guides, and the outer peripheral surface of the feeding rotation member protrudes further outwardly from, between, and beyond the semi-loop portions of the pair of guides than beyond the planar portions of the pair of guides, and applies a second frictional force, larger than the first frictional force, to the bill and stresses the bill traveling in the feeding path toward the bill storage portion, producing a V-shape in the bill as the bill travels along the semi-loop portions of the pair of guides toward the bill storage portion, to remove folds from the bill.

2. The bill transport and storage unit according to claim 1, wherein the bill storage portion is located adjacent to the guide device, and bills fed by the feeding device are successively placed and stacked in the bill storage portion.

3. The bill transport and storage unit according to claim 1, further comprising a bill detecting portion located in the feeding path and detecting a bill inserted into the feeding path, wherein the feeding rotation member is rotated to feed the bill to the bill storage portion only when the bill detecting portion detects the bill.

4. A bill handling machine comprising:

a bill insertion slot;

a bill validator having a bill validating portion that validates a bill inserted into the bill insertion slot, and a bill moving device that feeds a bill determined to be valid to a receiving position, and that feeds a bill determined to be invalid back to the bill insertion slot; and a bill transport and storage unit with a bill guide inlet located at the receiving position for receiving the bill delivered from the bill validator, the bill transport and storage unit comprising a bill storage portion, located under the validator, for storing bills, and a bill feeding device defining a feeding path for a bill to travel to reach the bill storage device, the bill feeding device comprising a guide device including a pair of guides spaced from each other along a direction perpendicular to the feeding path traveled by a bill to reach the bill storage portion, each guide including a planar portion and an adjoining semi-loop portion, the pair of guides being aligned so that the planar portions are co-planar and the semi-loop portions are coaxial, and a feeding rotation member disposed between the pair of guides, having an outer peripheral surface, and rotated about an axis generally parallel to the planar portions of the pair of guides, wherein the outer peripheral surface protrudes outwardly from, between, and beyond the planar portions of the pair of guides to engage and feed a bill in the feeding path, by applying a first frictional force to the bill, so the bill is fed along the planar portions of the pair of guides, and the outer peripheral surface of the feeding rotation member protrudes further outwardly from, between, and beyond the semi-loop portions of the pair of guides than beyond the planar portions of the pair of guides, and applies a second frictional force, larger than the first frictional force, to the bill and stresses the bill traveling in the feeding path toward the bill storage portion, producing a V-shape in the bill as the bill travels along the semi-loop portions of the pair of guides toward the bill storage portion, to remove folds from the bill.

5. The bill handling machine according to claim 4, wherein the bill storage portion is located adjacent to the guide device, and bills fed by the feeding device are successively placed and stacked in the bill storage portion.

6. The bill handling machine according to claim 4, further comprising a bill detecting portion located in the feeding path and detecting a bill inserted into the feeding path, wherein the feeding rotation member is rotated to feed the bill to the bill storage portion only when the bill detecting portion detects the bill.

7. The bill handling machine according to claim 4, wherein no signal is communicated between the bill validator and the bill storage unit.

* * * * *